US009466166B2

(12) United States Patent
Robinson

(10) Patent No.: US 9,466,166 B2
(45) Date of Patent: Oct. 11, 2016

(54) BANKNOTE VALIDATOR

(71) Applicant: Innovative Technology Limited, Oldham (GB)

(72) Inventor: Christopher Robinson, Oldham (GB)

(73) Assignee: Innovative Technology Limited, Oldham (GB)

( * ) Notice: Subject to any disclaimer, the term of this patent is extended or adjusted under 35 U.S.C. 154(b) by 0 days.

(21) Appl. No.: 14/887,666

(22) Filed: Oct. 20, 2015

(65) Prior Publication Data

US 2016/0189463 A1 Jun. 30, 2016

(30) Foreign Application Priority Data

Dec. 1, 2014 (GB) ..... 14212880.0

(51) Int. Cl.

| | |
|---|---|
| ***B65H 16/00*** | (2006.01) |
| ***G07D 11/00*** | (2006.01) |
| ***B65H 20/32*** | (2006.01) |
| ***G07F 17/32*** | (2006.01) |

(52) U.S. Cl.

CPC ..... *G07D 11/0018* (2013.01); *B65H 20/32* (2013.01); *G07D 11/0003* (2013.01); *G07F 17/3246* (2013.01)

(58) Field of Classification Search

CPC ..... G07D 11/0018; G07D 11/0003; B65H 16/005; B65H 20/32; G07F 17/3246

See application file for complete search history.

(56) References Cited

U.S. PATENT DOCUMENTS 5,954,438 A * 9/1999 Klein ..... B41J 11/70 101/226
2001/0022427 A1 9/2001 Ito
2004/0079614 A1 4/2004 Orton et al.
2008/0190730 A1* 8/2008 Smith ..... G07D 11/0006 194/206

FOREIGN PATENT DOCUMENTS

EP 2 390 103 A1 11/2011
EP 2 790 160 A1 10/2014

OTHER PUBLICATIONS

Search Report under Section 17—App. No. GB1421288.0, May 29, 2015 (1 page).

* cited by examiner

*Primary Examiner* — Mark Beauchaine
(74) *Attorney, Agent, or Firm* — Woodard, Emhardt, Moriarty, McNett & Henry LLP

(57) ABSTRACT

A banknote validator (1) including a banknote transport mechanism (9) and a detachable printer module (3), said printer module comprising: a media printer device (10); a print media transport passage (11) interconnecting a print media input aperture (12) and the banknote transport mechanism (9) via the media printer device (10). A first wall section (13) of the print media passage disposed between the media printer device and the banknote transport mechanism is moveable to create a vent (14) that opens to the exterior of the banknote validator.

12 Claims, 7 Drawing Sheets

BANKNOTE VALIDATOR

REFERENCE TO RELATED APPLICATION

This application claims priority of Great Britain Application No. 14 212 88.0, filed 1 Dec. 2014, the disclosure of which is incorporated herein by reference in its entirety.

BACKGROUND OF THE INVENTION

1. Field of the Invention

The present invention relates to a device for handling and validating flexible sheets or documents. More specifically, the present invention relates to a device for validating banknotes that also includes the capability to print and dispense flexible documents such as coupons, vouchers or tickets.

2. Description of the Related Prior Art

Various types of banknote validators are known in the art. A conventional banknote validator is disclosed in EP-B-1, 415,281.

With reference to FIGS. 1 and 2, EP-B-1,415,281 describes a banknote validator 100 comprising a cash box 101, a banknote transport mechanism 102, and a hingedly attached lid 103. The upper front portion of the lid 3 supports a bezel 104 that includes a banknote aperture 105 for receiving banknotes requiring validation.

A banknote 107 input through the banknote aperture 105 is transported in an infeed direction 108 via operation of a pair of flexible continuous drive belts 106. The note path traversed by the banknote 107 continues to the underside of the banknote transport mechanism 102 from where it may be deposited into the cash box 101 via a pusher mechanism (not shown).

It is common for devices such as gaming machines or vending machines, which typically host a banknote validator as shown in FIG. 1, to print vouchers or tickets to be dispensed to a user of the machine. Such tickets can be of a promotional type or they can be printed with a barcode that represents a prize or a cash value redeemable from either the machine from which it was printed or from a remote location.

Conventionally, host machines will include a device for the printing of vouchers or tickets in combination with a separate device for accepting/dispensing banknotes.

FIG. 3 shows a device which combines banknote validation with voucher printing. The illustrated banknote validator 1 comprises a validator module 2, a printer module 3, a cash box 4, and a bezel 5. The printer module 3 includes a print media holder 6 in which a roll of print media 7 is accommodated. Here, the roll of print media 7 provides a continuous supply of paper onto which a media printer device [not shown] prints the required information. This information can be in the form of a barcode, promotional advertising, or any such other printable information. Once printed upon, the print media is cut to form a ticket or voucher which is dispensed to a user.

As schematically shown in FIG. 4, the printed ticket 7' is transported to an input/output aperture 5' located on a user accessible front face of the bezel 5. The ticket 7' is transported by a banknote transport mechanism 9 operating in a reverse direction to that employed when a banknote is being received from a user.

A problem exists with the arrangement shown in FIG. 4 in that the length of the ticket 7', and hence the amount of information printable upon it, is limited by the physical length of the banknote transport mechanism 9, since to print a ticket which exits the input/output aperture 5' before the print operation is complete makes possible the situation in which the user can attempt to withdraw the ticket by pulling it in a direction indicated by arrow 8' [see FIG. 5]. In this event it is likely that the printing process will be compromised by, for example, smudging due to the recipient tugging on the leading edge of the ticket protruding from the bezel 5 and/or the ticket tearing or breaking at some point along its length due to the applied tugging force. The present invention arose from attempts to overcome this problem.

BRIEF SUMMARY OF THE INVENTION

According to an aspect of the present invention there is provide a banknote validator including a banknote transport mechanism and a detachable printer module, said printer module comprising: a media printer device; a print media transport passage interconnecting a print media input aperture and the banknote transport mechanism via the media printer device; wherein a first wall section of the print media passage disposed between the media printer device and the banknote transport mechanism includes a print media exit.

Preferably, the print media exit comprises a flap in the first wall section moveable to expose a vent that opens to the exterior of the banknote validator.

Preferably, the flap is pivotably moveable between an open and a closed position, and it is biased in the closed position.

Advantageously, a second wall section of the print media transport passage proximal to the banknote transport mechanism is moveable between a first position in which communication between the print media transport passage and the banknote transport mechanism is open, and a second position in which communication between the print media transport passage and the banknote transport mechanism is closed.

When the second wall section is in the first position, print media input from a print media holder via the print media input aperture is feedable to the banknote transport mechanism via the print media transport passage.

Preferably, the printer module includes a sensor configured to detect the ingress of print media into the banknote transport mechanism, and detection of print media ingress ceases operation of the banknote transport mechanism until a media printer device print operation has ceased.

Advantageously, media printer device print operations requiring a length of print media greater than a length of the print media transport passage causes said print media to coil in a space proximal to the outer wall section such that pressure exerted onto said wall section by said print media causes the outer wall section to move into the open position so as to expose the vent allowing egress of the print media into the exterior of the banknote validator.

In a preferred embodiment the length of the print media transport passage is delimited by the print media input aperture and the banknote transport mechanism, and the printer module is configured to releasably connect to the banknote validator and operatively engage with the banknote transport mechanism.

The banknote transport mechanism preferably includes a banknote transport path, and wherein a section of the banknote transport path is formed by an underside portion of the printer module, said underside portion configured to mate with the banknote transport mechanism.

BRIEF DESCRIPTION OF THE DRAWINGS

An embodiment of the present invention will now be described, by way of example only, with reference to the accompanying schematic drawings, in which.

DESCRIPTION OF THE PREFERRED EMBODIMENT

Figure 1:
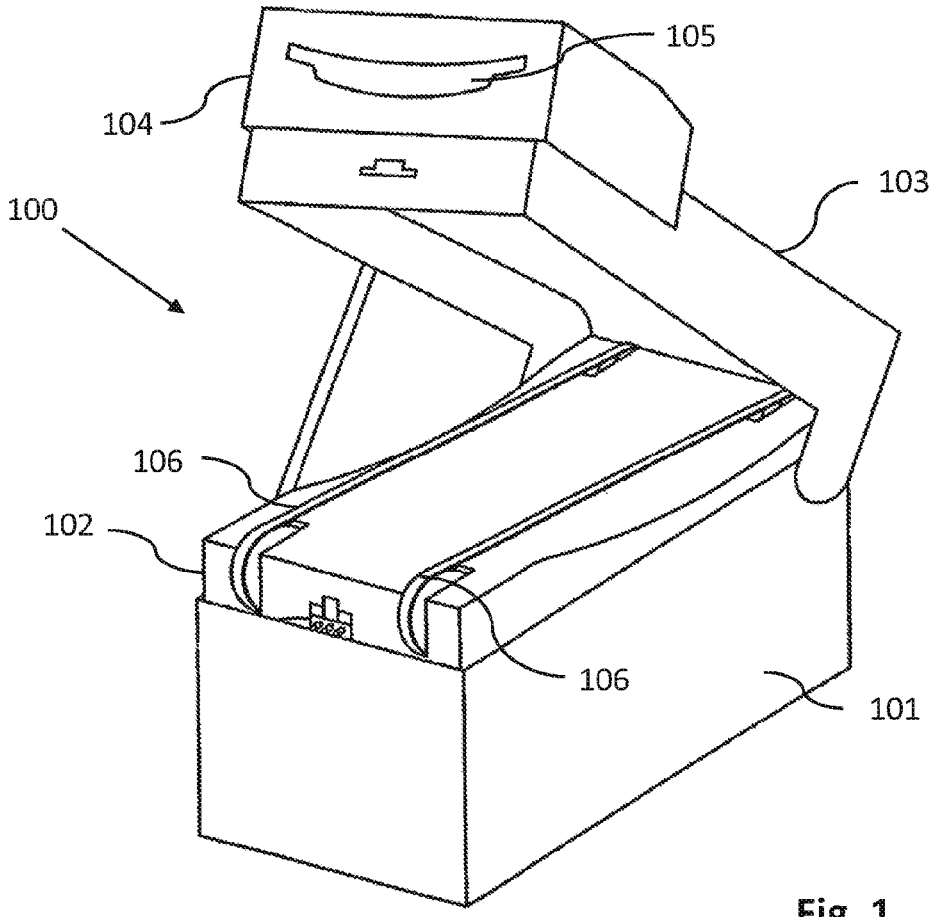
Fig. 1. PRIOR ART
FIG. 1 shows a perspective view of a prior art banknote validator.
Figure 2:
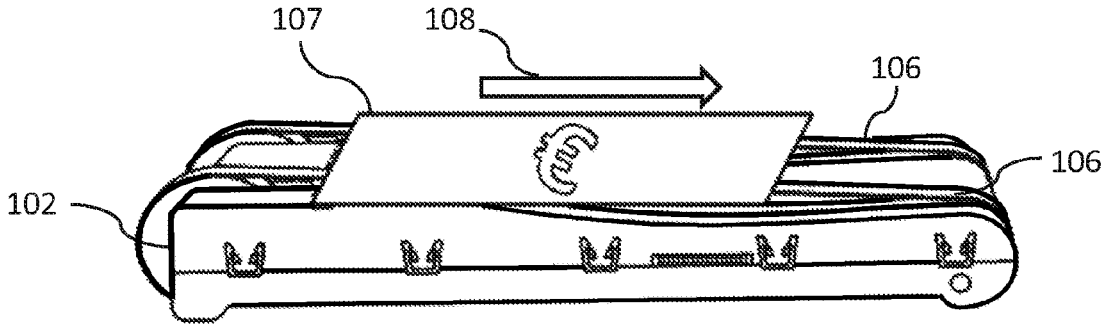
PRIOR ART Fig. 2.
FIG. 2 shows the banknote transport mechanism of the banknote validator shown in FIG. 1.
Figure 3:
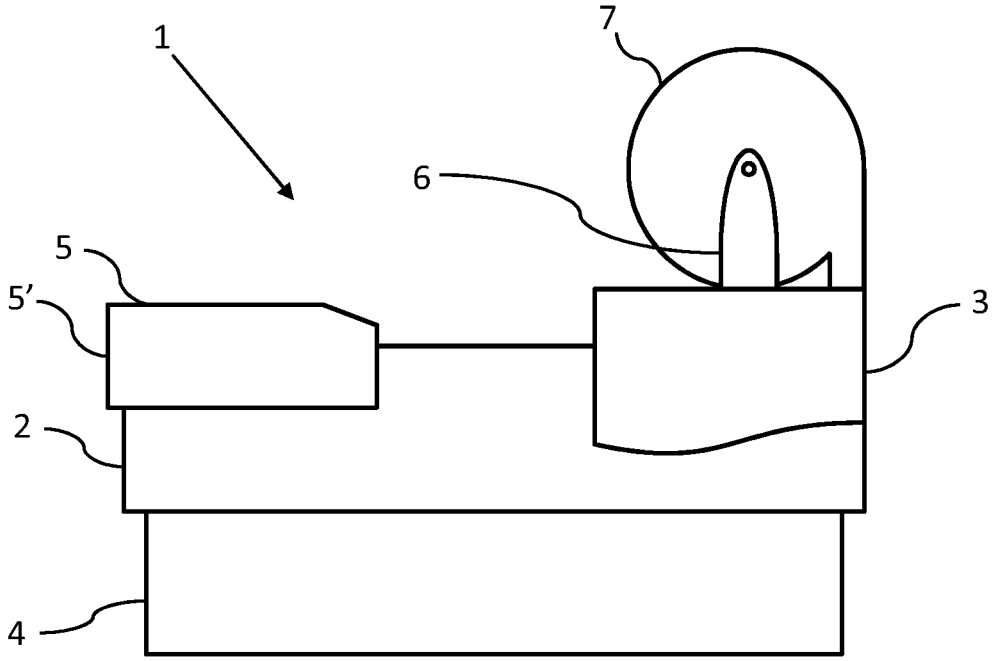
FIG. 3 shows an elevation view of a combination banknote validator.
Figure 4:
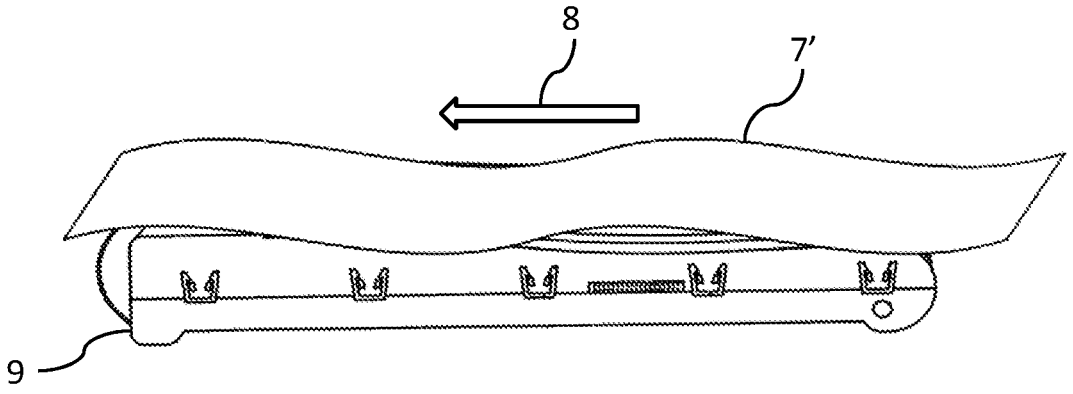
FIG. 4 shows the banknote transport mechanism of the combination banknote validator shown in FIG. 3.
Figure 5:
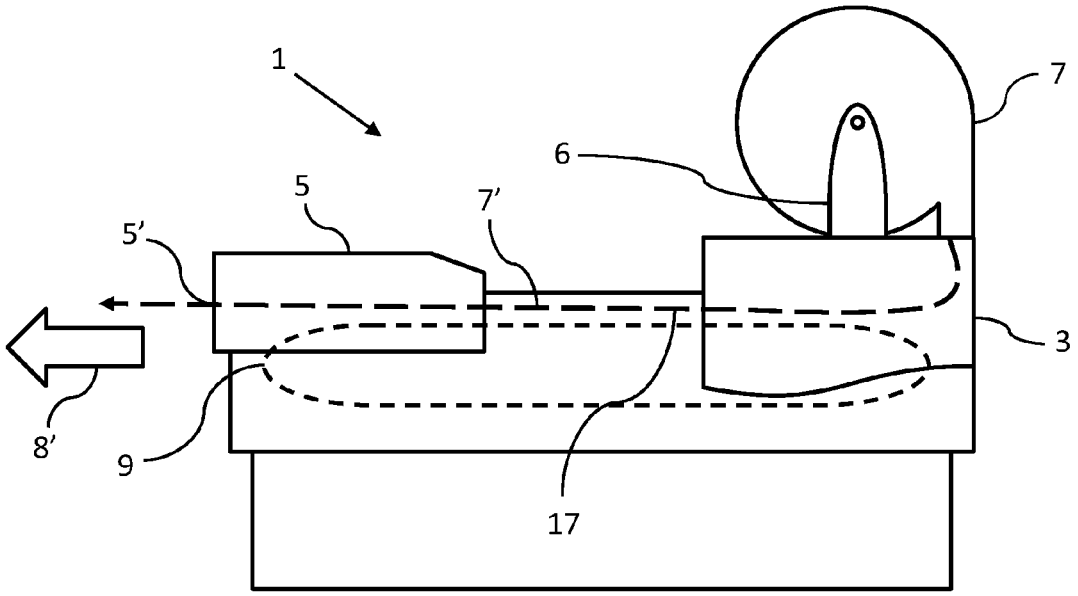
FIG. 5 shows further details of the combination banknote validator.
Figure 6:
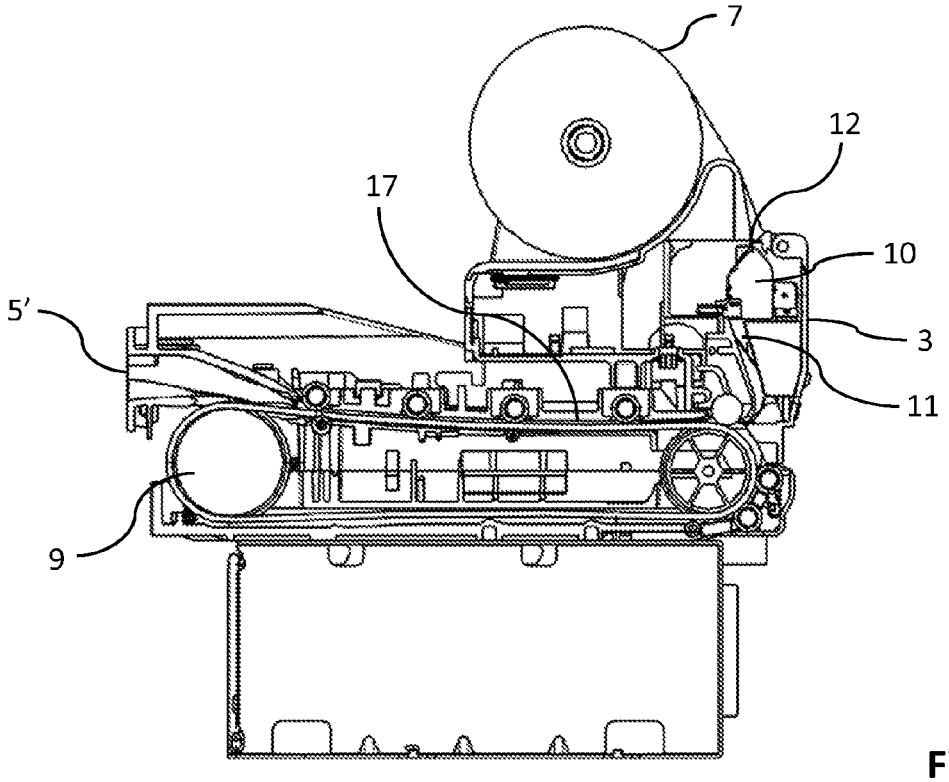
FIG. 6 shows a sectional elevation view of the banknote validator of the present invention.

As shown in FIG. 6, the banknote validator includes a banknote transport path 17 interconnecting the input/output aperture 5' with a media printer device 10 housed within the printer module 3. Print media 7, which in a preferred embodiment is a continuous roll of paper supported and accommodated by a print media holder 6, is fed into the printer module 3 via a print media input aperture 12 located in an upper surface of the printer module 3. From the input aperture 12 the print media 7 (hereinafter referred to as 'paper ticket') is fed through the printer device 10 and from there it passes into a print media transport passage 11 disposed within the interior of the printer module 3.

Figure 7A:
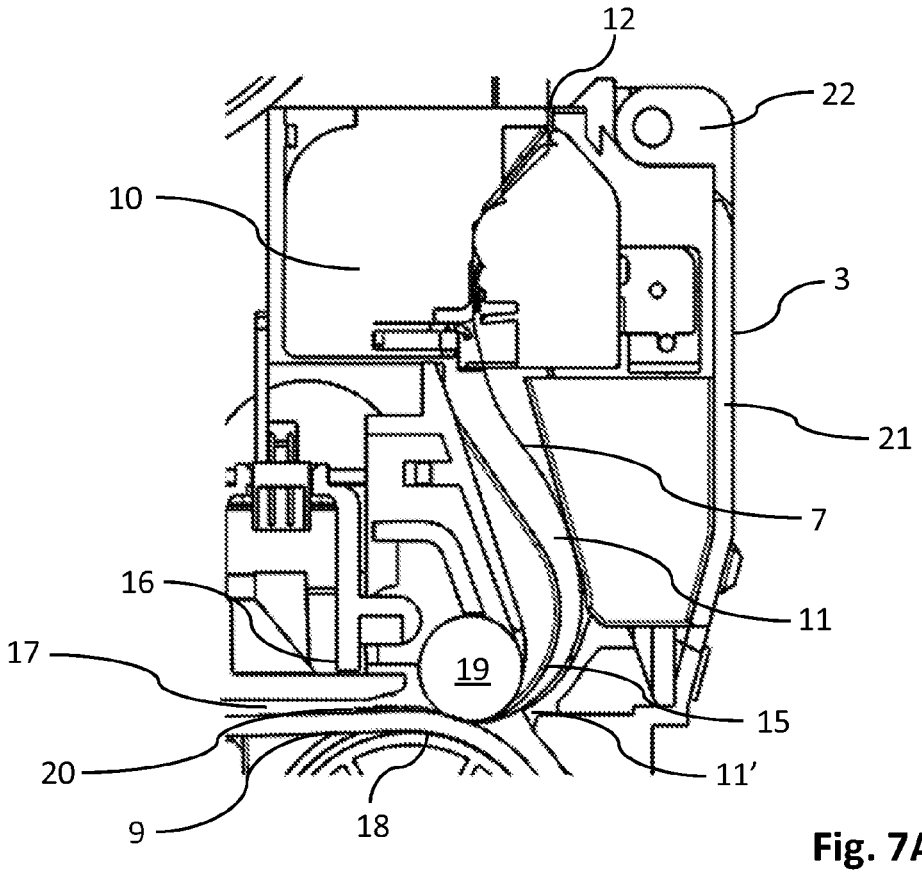
FIGS. 7A to 7C show partial sectional views of the operation of the banknote validator of the present invention.
Figure 7B:
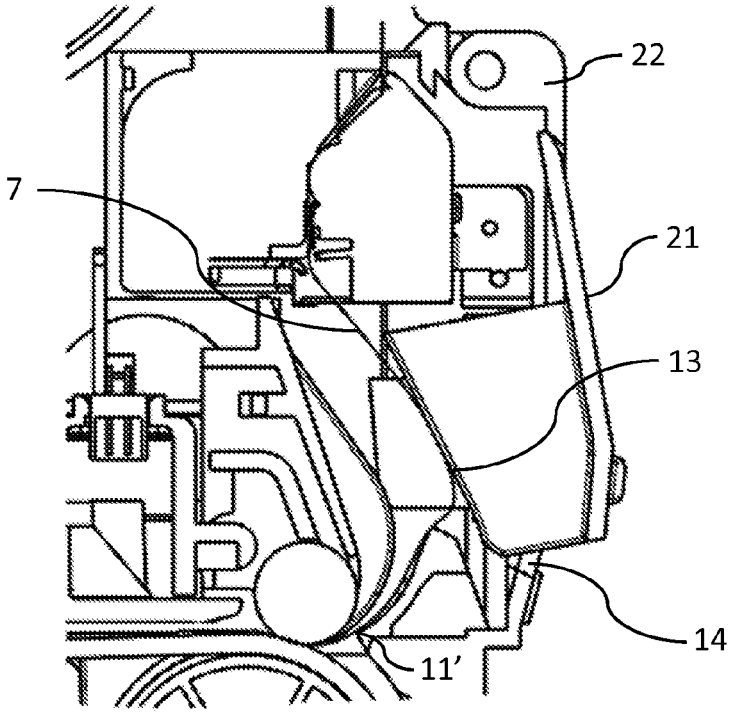
Figure 7C:
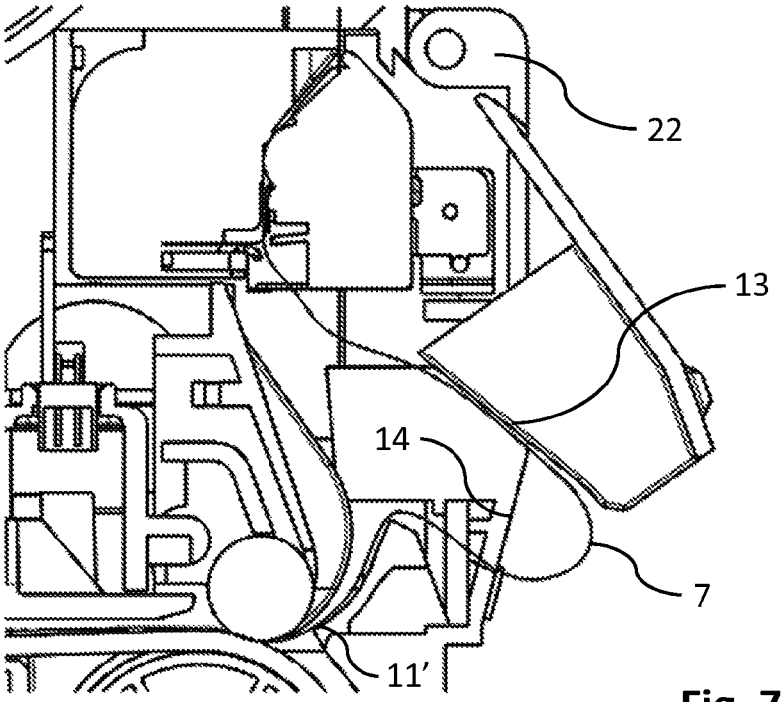

With reference to FIGS. 7A to 7C, the print media transport path 11 communicates with the banknote transport mechanism 9 through a closeable aperture 11' located at a point in the print media transport path 11 distal from the printer device 10.

In an 'accept' mode, the banknote transport mechanism 9, once activated, travels in a clockwise direction so as to receive and transfer banknotes from the input/output aperture 5'.

When a 'print' mode is instigated, the banknote validator 1 reverses the banknote transport mechanism 9 such that it is travelling in an anticlockwise direction ('reject' mode), and the media printer device 10 commences a print operation. The rate at which the paper ticket 7 is fed into the printer module 3 is synchronised with the print mechanism of the printer device 10 such that a continuous ticket is printed until a print cessation command is received by the media printer device 10.

As the printed ticket progresses downstream from the printer device 10 through the print media transport passage 11, the leading edge of the ticket 20 encounters a junction between the transport mechanism drive belt 18 and a pinch wheel 19. Since the banknote transport mechanism 9 is travelling in the anticlockwise 'print' mode, the leading edge of the ticket is fed through into the banknote transport path 17 until it is detected by the optical sensor 16.

Light reflected from the leading edge 20 of the ticket is received by the optical sensor 16 activating a 'stop' mode in which the banknote transport mechanism 9 is halted and held in a stationary position. In a preferred embodiment, light is transmitted and received by the optical sensor 16 through a single light pipe. However, it should be noted that any detection method, of which there are numerous known in the art, can be used to detect the leading edge 20 of the printed ticket.

Activation of the 'stop' mode creates a pinch point between the transport mechanism drive belts 18 (only one is shown) and the pinch wheels 19 (only one is shown) by contact friction between these elements. The pinch point prevents further downstream progress of the paper ticket 7 into the banknote transport path 17, resulting in the paper ticket 7 being forced to recoil backwards into the upstream path section of the print media transport passage 11.

As the print operation continues the length of paper ticket 7 fed into the print media transport passage 11 increases and, as a result of this, the recoiling paper ticket 7 retreating backwards into the print media transport passage 11 comes into contact with a first wall section 13 of the print media transport passage 11 [see FIGS. 7A and 7B]. The first wall section 13 forms the inner wall of a hingedly attached rear flap 21 of the printer module 3.

As the length of the paper ticket 7 entering the print media transport passage 11 continues to increase, there is a commensurate increase in the quantity of coiled paper accumulating in the print media passage 11. This build-up of coiling paper pushing on the first wall section 13 ultimately leads (unless the print operation ceases) to the rear flap 13 pivoting outwards to reveal a vent 14.

As the build-up of paper continues due to the ongoing print operation, the vent 14 increases in size as the rear flap 13 continues to pivot outwards into the space behind the rear of the banknote validator 1. In practice this space will be a void within the machine hosting the banknote validator. The vent 14 continues to increase in size until the opening is sufficiently large enough to allow the coiled paper ticket 7 to spool outwards into the void behind the banknote validator 1. This process continues until the media printer device 10 ceases the print operation.

When the print operation ceases, the upstream trailing edge of the ticket is severed from the supply of paper by operation of a paper cutting device integral to the media printer device 10 [not shown]. The paper ticket 7 then has a finite length delimited by the leading edge 20 positioned proximal to the optical sensor 16 and the severed end positioned proximal to the paper cutting device. The majority of the length of ticket disposed therebetween has spooled out into the adjacent void behind the banknote validator 1.

When the print operation ceases and the ticket has been severed from the paper supply, the validator switches the banknote transport mechanism 9 into 'reject' mode, i.e. the drive belts 18 are driven in an anticlockwise fashion.

In the 'reject' mode the leading edge 20 of the paper ticket 7 is fed into the banknote transport path 17 and dispensed out from the input/output aperture 5'. The banknote transport mechanism 9 continues to operate in the 'reject' mode until it has been detected that the trailing edge of the printed paper ticket 7 is proximal to the input/output aperture 5'. From this point the recipient of the paper ticket simply pulls the remaining section from the banknote validator. In this way, the banknote validator of the present invention is advantageously able to print tickets of varying length, and the length of these tickets is not dependent upon the internal dimensions of the banknote transport mechanism 9 or the banknote transport path 17.

Figure 8:
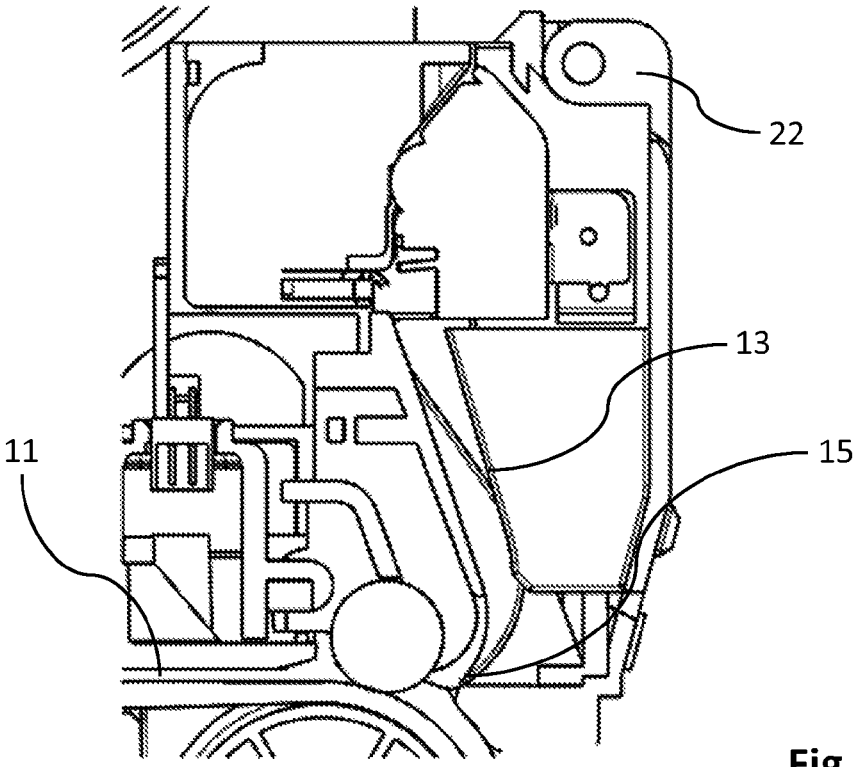
FIG. 8 shows a further partial sectional view of the banknote validator of the present invention.

In an 'accept' mode, and as shown in FIG. 8, an inner second wall section 15 of the print media transport passage 11 is driven rearwards towards the first wall section 13 by a diverter mechanism [not shown] to close the aperture 11'. Closing the aperture 11' blocks communication between the banknote transport mechanism 9 and the media transport passage 11, thus diverting incoming banknotes [not shown] downwards to the underside of the banknote transport mechanism 9 from where they can be processed.

Figure 9:
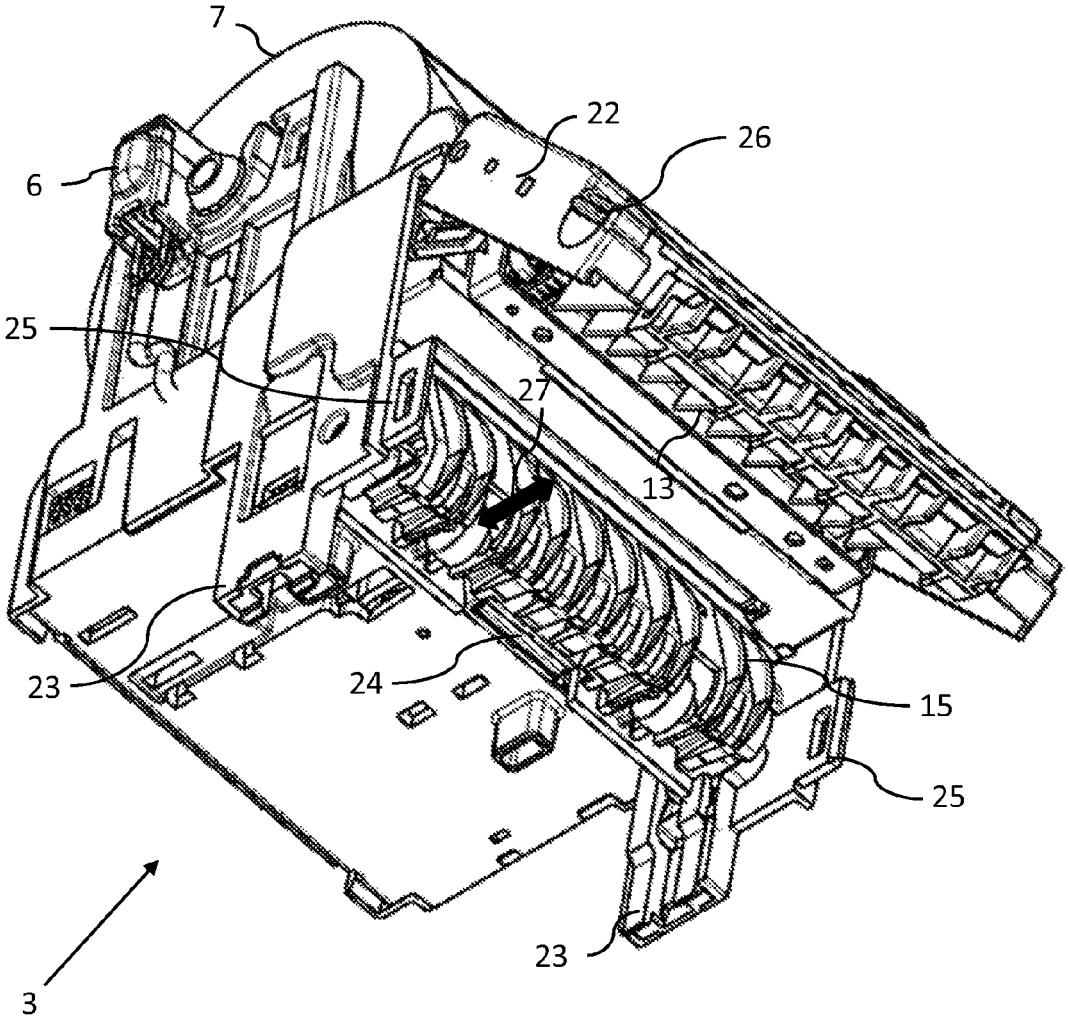
FIG. 9 is an underside perspective view of a printer module of the present invention.

FIG. 9 shows an underside perspective view of the printer module 3. The rear face 22 of the printer module 3 is shown in an open position. The "rear face" of the printed module is defined as that face which is opposed to, and distal from, the face of the bezel 5 that includes the input/output aperture 5'. It should be noted that the rear face 22 is pivotable between an open and a closed position and, when in a closed position, the rear face 22 is secured in this position by interaction between locking lugs 25 and push-release buttons 26 (only one is shown in FIG. 9). When in a closed position, the rear face 22 may be pivotally opened by a user depressing both push-release buttons 26 such that the rear face disengages with the pair of locking lugs 25. Advantageously, this allows for the inspection and removal of any paper jams occurring within the printer module 3.

It should be understood that the above discussed rear flap 21 is an integral element of the rear face 22, but it is a separate element that is moveable independently of the rear face 22; the rear face 22 is kept in a closed position during normal operation.

Also shown in FIG. 9 is the second wall section 15 which acts as a diverter mechanism moveable in a reciprocating manner as indicated by arrow 27. Consequently, when the rear face 22 is in a closed position, the second wall section 15 can reciprocate between a position where the aperture 11' [see FIGS. 7A to 7C] between the first wall section 13 and the second wall section 15 is at a maximum (i.e. open), and a position in which the aperture 11' is closed [see FIG. 8].

Advantageously, the printer module 3 also includes a barcode reader 24 positioned downstream from the aperture 11'. Consequently, printed tickets, vouchers or the like emanating from the printer module can be scanned for an appropriate barcode allowing for the recordation and verification of printed tickets etc.

The printer module 3 also includes engagement arms 23 which mate with corresponding receiving portions positioned to the rear of the validator module 2. In this way, the printer module 3 can be releasably locked to the body of the validator module 2.

Figure 10:
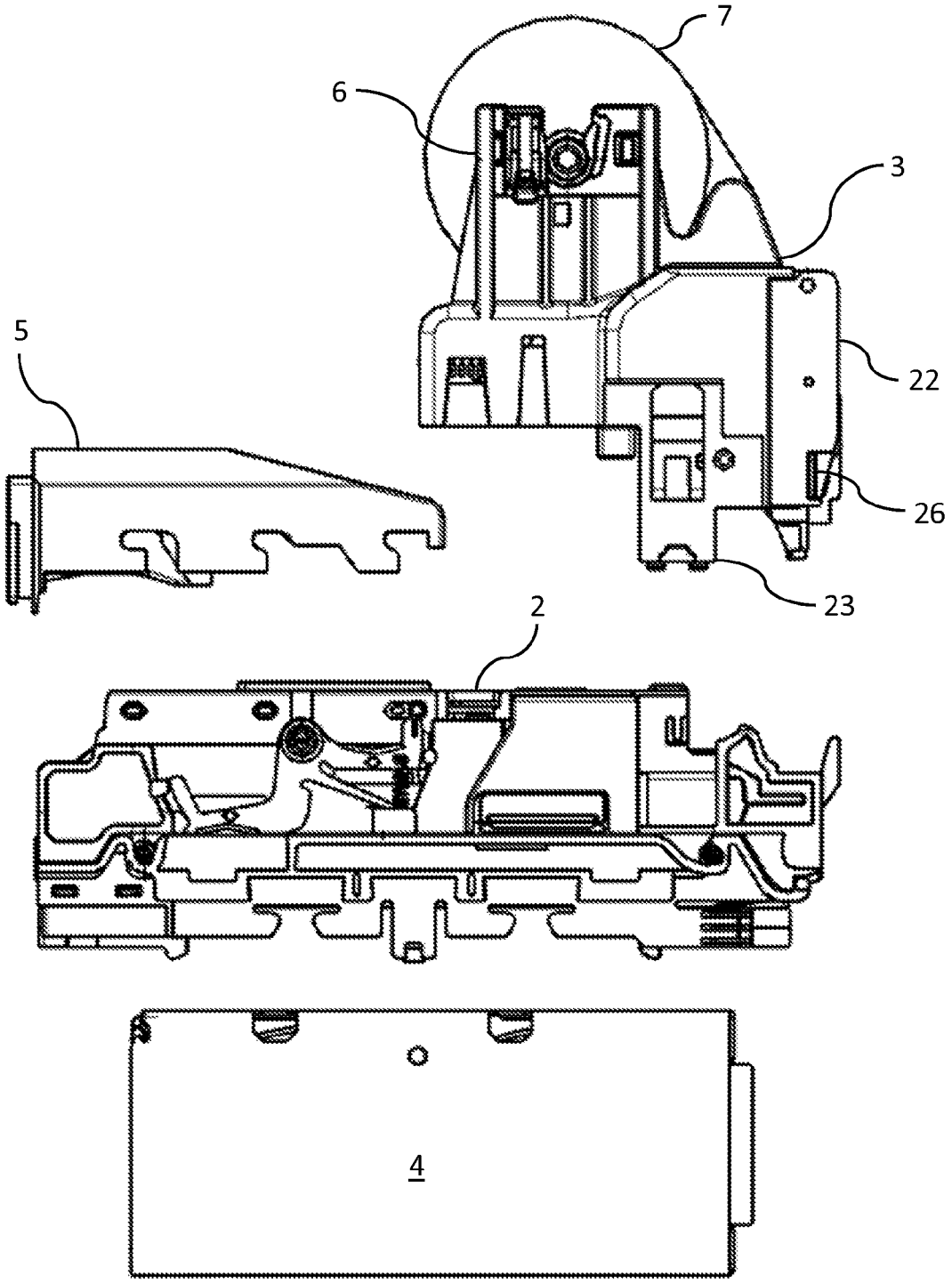
FIG. 10 is an exploded sectional view of the banknote validator showing the constituent modular components which comprise the banknote validator.

With reference to FIG. 10, the banknote validator of the present invention is modular and comprises four separate removable and interlocking parts: a validator module 2; a printer module 3; a cash box 4; and a bezel 5.

The invention claimed is:

1. A banknote validator including a banknote transport mechanism and a detachable printer module, said printer module comprising:

a media printer device;

a print media transport passage interconnecting a print media input aperture and the banknote transport mechanism via the media printer device;

wherein a first wall section of the print media passage disposed between the media printer device and the banknote transport mechanism includes a print media exit; and further comprising:

a flap in the first wall section moveable to expose a vent that opens to the exterior of the banknote validator.

2. A banknote validator as claimed in claim 1, wherein the flap is pivotably moveable between an open and a closed position, and wherein said flap is biased in a closed position.

3. A banknote validator as claimed in claim 1, wherein a second wall section of the print media transport passage proximal to the banknote transport mechanism is moveable between a first position in which communication between the print media transport passage and the banknote transport mechanism is open, and a second position in which communication between the print media transport passage and the banknote transport mechanism is closed.

4. A banknote validator as claimed in claim 3, wherein when the second wall section is in the first position, print media input from a print media holder via the print media input aperture is feedable to the banknote transport mechanism via the print media transport passage.

5. A banknote validator as claimed in claim 1, wherein the printer module includes a sensor configured to detect the ingress of print media into the banknote transport mechanism.

6. A banknote validator as claimed in claim 5, wherein detection of print media ingress ceases operation of the banknote transport mechanism until a media printer device print operation has ceased.

7. A banknote validator as claimed in claim 1, wherein the printer module is configured to releasably connect to the banknote validator and operatively engage with the banknote transport mechanism.

8. A banknote validator as claimed in claim 7, wherein the banknote transport mechanism includes a banknote transport path, and wherein a section of the banknote transport path is formed by an underside portion of the printer module, said underside portion configured to mate with the banknote transport mechanism.

9. A banknote validator as claimed in claim 1, wherein the printer module includes a barcode reading device.

10. A banknote validator as claimed in claim 1, wherein the flap is an integral part of a rear face of the printer module, said rear face being independently pivotable between and open and a closed position.

11. A banknote validator including a banknote transport mechanism and a detachable printer module, said printer module comprising:

a media printer device;

a print media transport passage interconnecting a print media input aperture and the banknote transport mechanism via the media printer device;

wherein a first wall section of the print media passage disposed between the media printer device and the banknote transport mechanism includes a print media exit; and wherein:

the printer module includes a sensor configured to detect the ingress of print media into the banknote transport mechanism, detection of print media ingress ceases operation of the banknote transport mechanism until a media printer device print operation has ceased, wherein media printer device print operations requiring a length of print media greater than a length of the print media transport passage causes said print media to coil in a space proximal to the outer wall section such that pressure exerted onto said wall section by said print media causes the outer all section to move into the open position so as to expose the vent allowing egress of the print media into the exterior of the banknote validator.

12. A banknote validator as claimed in claim 11, wherein the length of the print media transport passage is delimited by the print media input aperture and the banknote transport mechanism.

* * * * *